US009027532B2

(12) United States Patent
Peters et al.

(10) Patent No.: US 9,027,532 B2
(45) Date of Patent: May 12, 2015

(54) METHOD AND SYSTEM FOR FUEL VAPOR CONTROL

(75) Inventors: Mark W. Peters, Wolverine Lake, MI (US); Robert Roy Jentz, Westland, MI (US); Darrell Erick Butler, Macomb, MI (US); Aed Mohammad Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 818 days.

(21) Appl. No.: 13/291,561

(22) Filed: Nov. 8, 2011

(65) Prior Publication Data

US 2013/0112176 A1 May 9, 2013

(51) Int. Cl.
*F02M 33/02* (2006.01)
*F02M 25/08* (2006.01)

(52) U.S. Cl.
CPC ..... *F02M 25/0809* (2013.01); *F02M 25/089* (2013.01)

(58) Field of Classification Search
CPC ..... F02M 25/0809; F02M 25/08; F02M 25/0836; F02M 25/089; F02D 41/0032; F02D 41/004
USPC ..... 123/516, 518, 519, 520; 73/114.39
See application file for complete search history.

(56) References Cited

U.S. PATENT DOCUMENTS

| | | | | | |
|---|---|---|---|---|---|
| 4,026,258 | A * | 5/1977 | Ino et al. | 123/520 |
| 4,318,383 | A * | 3/1982 | Iritani et al. | 123/520 |
| 4,702,216 | A * | 10/1987 | Haruta et al. | 123/520 |
| 5,113,834 | A * | 5/1992 | Aramaki | 123/520 |
| 5,150,689 | A * | 9/1992 | Yano et al. | 123/519 |
| 5,305,724 | A * | 4/1994 | Chikamatsu et al. | 123/520 |
| 5,317,909 | A * | 6/1994 | Yamada et al. | 73/114.39 |
| 5,327,873 | A * | 7/1994 | Ohuchi et al. | 123/520 |
| 5,345,917 | A * | 9/1994 | Maruyama et al. | 123/520 |
| 5,494,021 | A * | 2/1996 | Yoneyama | 123/520 |
| 6,487,892 | B1 * | 12/2002 | Ito et al. | 73/49.2 |
| 6,810,862 | B2 * | 11/2004 | Bergsma | 123/519 |
| 7,077,112 | B2 * | 7/2006 | Mitani et al. | 123/518 |
| 7,086,392 | B2 * | 8/2006 | Suzuki | 123/698 |
| 7,204,239 | B2 * | 4/2007 | Iriyama | 123/520 |
| 8,019,525 | B2 * | 9/2011 | DeBastos et al. | 701/102 |
| 8,056,540 | B2 * | 11/2011 | DeBastos et al. | 123/521 |
| 8,191,536 | B2 * | 6/2012 | Devries et al. | 123/520 |
| 8,336,526 | B1 * | 12/2012 | Martin et al. | 123/518 |
| 8,371,272 | B1 * | 2/2013 | Martin et al. | 123/520 |
| 2002/0046609 | A1 | 4/2002 | Ito | |
| 2003/0183206 | A1 | 10/2003 | Fujimoto et al. | |
| 2006/0016252 | A1 | 1/2006 | Iriyama | |
| 2007/0068227 | A1 * | 3/2007 | Tsuyuki et al. | 73/49.7 |
| 2011/0168140 | A1 * | 7/2011 | DeBastos et al. | 123/521 |

* cited by examiner

*Primary Examiner* — Thomas Moulis
(74) *Attorney, Agent, or Firm* — Julia Voutyras; Alleman Hall McCoy Russell & Tuttle LLP

(57) ABSTRACT

Methods and systems are provided for generating sufficient vacuum to enable a leak detection routine. While a fuel tank pressure is within mechanical limits, fuel vapors are purged from a canister to an engine with an isolation valve open to generate a desired level of vacuum in the fuel tank. Thereafter, the fuel tank is isolated and leak detection is performed concurrent to the purging.

18 Claims, 5 Drawing Sheets

METHOD AND SYSTEM FOR FUEL VAPOR CONTROL

FIELD

The present application relates to fuel vapor purging and leak detection in vehicles, such as hybrid vehicles.

BACKGROUND AND SUMMARY

Reduced engine operation times in hybrid vehicles enable fuel economy and reduced fuel emissions benefits. However, the shorter engine operation times can lead to insufficient purging of fuel vapors from the vehicle's emission control system as well as insufficient time for completion of a fuel system leak diagnostics operation. To address some of these issues, hybrid vehicles may include a fuel tank isolation valve (FTIV) between a fuel tank and a hydrocarbon canister of the emission system to limit the amount of fuel vapors absorbed in the canister. An opening or closing of the FTIV may then be adjusted based on fuel system conditions to enable fuel vapor purging or leak diagnostics.

One example approach for fuel system control is shown by Fujimoto et al. in US 2003/0183206. Therein, when conditions for performing a leak diagnostics routine exist, the fuel tank isolation valve is closed while a canister purge rate is varied between a low purge rate and a high purge rate. A change in fuel tank pressure between the high canister purge rate condition and the low canister purge rate condition is used to infer fuel system degradation.

However, the inventors herein have identified potential issues with such an approach. As one example, fuel vapor purging operations may compete with the leak diagnostics routine for available time during the vehicle drive cycle. In other words, while the (higher and lower) purge rates may be sufficient to enable fuel system degradation to be identified, the duration of purging may not be long enough to enable the canister to be sufficiently purged. As a result, during a subsequent drive cycle, fuel vapors may not be stored and exhaust emissions may be degraded. On the other hand, if the purging operation is allowed to continue to empty the stored fuel vapors, there may not be enough drive cycle time left to perform the leak detection routine. As a result, fuel system degradation may not be timely determined and exhaust emissions may again get degraded.

In one example, some of the above issues may be at least partly addressed by a method of operating a fuel system including a fuel tank coupled to a fuel vapor canister via an isolation valve. The method may comprise purging fuel vapors from the canister to an engine intake for a duration with the isolation valve open until a threshold level of fuel tank vacuum is generated. In this way, the vacuum generation potential of a purging operation can be advantageously used to generate the vacuum required for a leak detection routine.

In one example, when purging conditions are met, and when a purge flow rate (as determined based on a canister load and the engine speed-load conditions) is higher than a threshold rate, it may be determined that a purging operation has vacuum generation potential. If there is insufficient fuel tank vacuum for performing a leak detection diagnostic routine (e.g., the fuel tank vacuum level is lower than a target level), the purging may be performed with the isolation valve open for a duration until the target level of vacuum is attained. Once the target fuel tank vacuum is achieved, the isolation valve may be closed to isolate the fuel tank and initiate a leak detection routine. For example, a bleed up rate of the fuel tank vacuum may be monitored to identify a fuel tank leak.

Optionally, the purging may be continued with the isolation valve closed such that fuel vapor purging to the engine intake and fuel tank leak detection are performed simultaneously.

In this way, by purging fuel vapors from a canister with an isolation valve open for at least a duration of the purging, fuel vapor purging may be opportunistically used to reduce a fuel tank pressure to a desired vacuum level, such as a vacuum level at which a pressure decay based leak diagnostics routine can be performed. Thereafter, by purging with the isolation valve closed while a leak detection routine is performed, both fuel vapor purging and leak diagnostics can be performed and completed within the same vehicle drive cycle. In addition, cycle to cycle variation in test results may be reduced. By improving the completion frequency of both purging and leak detection operations, emissions compliance may also be better ensured.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
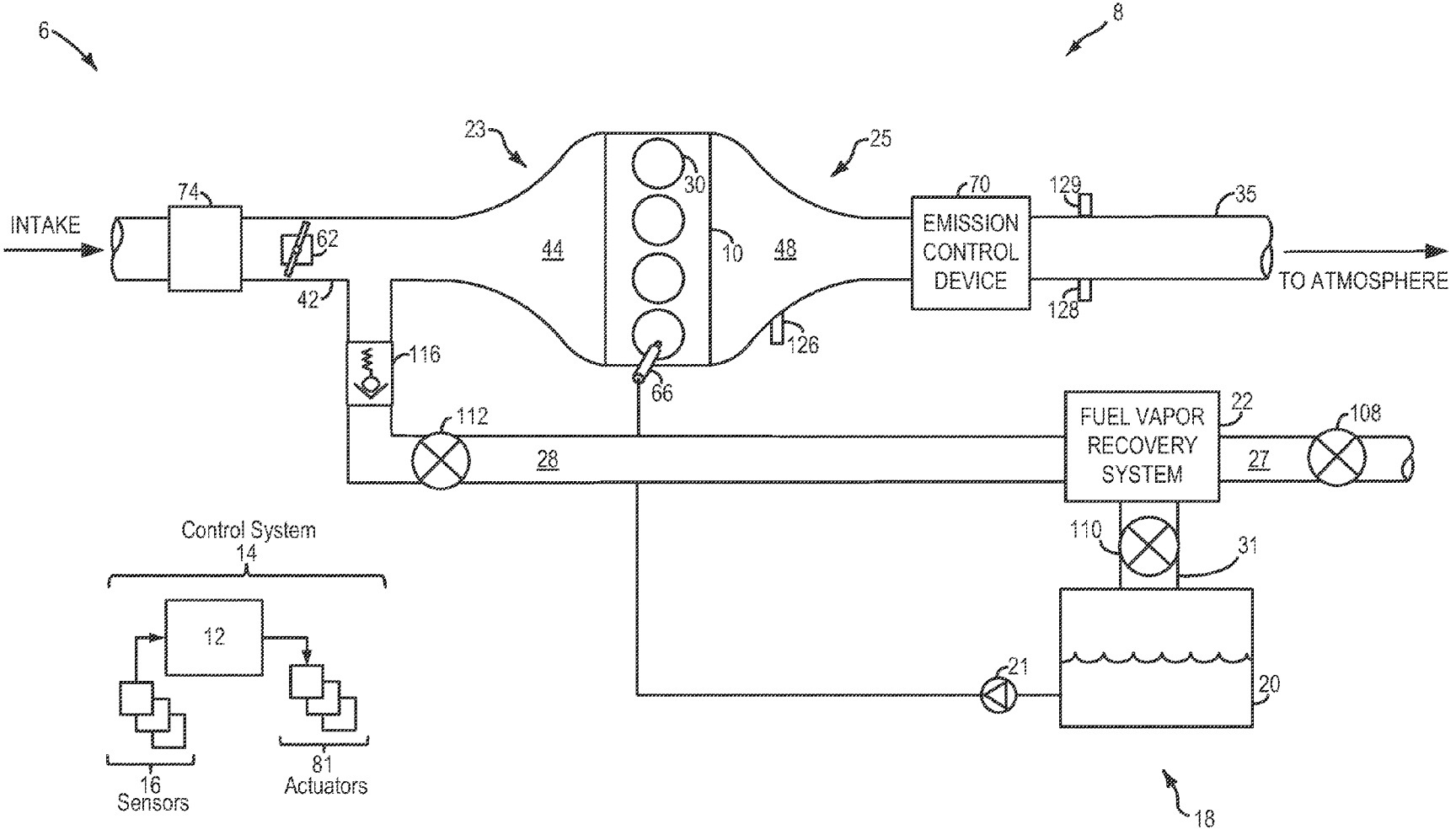
FIG. 1 shows a schematic depiction of an engine and an associated fuel system.
Figure 2:
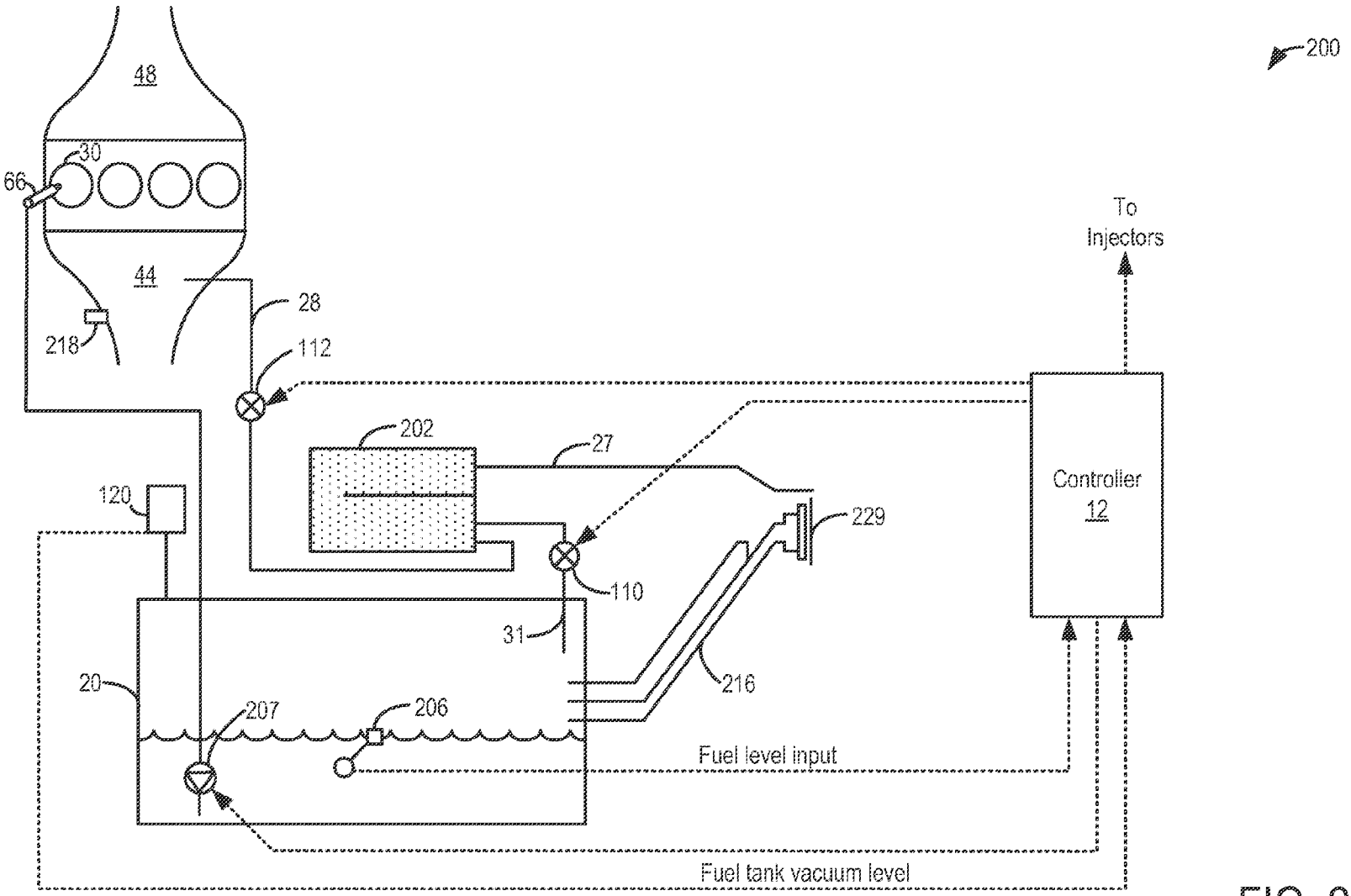
FIG. 2 shows an embodiment of the fuel system of FIG. 1.

The following description relates to systems and methods for operating a fuel system, such as the system of FIG. 2, coupled to an engine system, such as the engine system of FIG. 1. During selected purging conditions, the vacuum generation potential of a purging operation (FIG. 4) may be advantageously used to draw a desired level of fuel tank vacuum. An engine controller may be configured to perform control routines, such as the example routine of FIG. 3, to purge fuel vapors from a canister to an engine intake with an isolation valve open so as to generate fuel tank vacuum. The isolation valve may be subsequently closed so that the purging can be continued while the generated vacuum is applied to identify leaks in the fuel system. Example purging operations with vacuum generation are described in FIG. 5.

FIG. 1 shows a schematic depiction of a hybrid vehicle system 6 that can derive propulsion power from engine system 8 and/or an on-board energy storage device (not shown), such as a battery system. An energy conversion device, such as a generator (not shown), may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes a throttle 62 fluidly coupled to the engine intake manifold 44 via an intake passage 42. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in the example embodiment of FIG. 2.

In some embodiments, engine intake 23 may further include a boosting device, such as a compressor 74. Compressor 74 may be configured to draw in intake air at atmospheric air pressure and boost it to a higher pressure. As such, the boosting device may be a compressor of a turbocharger, where the boosted air is introduced pre-throttle, or the compressor of a supercharger, where the throttle is positioned before the boosting device. Using the boosted intake air, a boosted engine operation may be performed.

Engine system 8 may be coupled to a fuel system 18. Fuel system 18 may include a fuel tank 20 coupled to a fuel pump system 21 and a fuel vapor recovery system 22. Fuel tank 20 may hold a plurality of fuel blends, including fuel with a range of alcohol concentrations, such as various gasoline-ethanol blends, including E10, E85, gasoline, etc., and combinations thereof. Fuel pump system 21 may include one or more pumps for pressurizing fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system. Vapors generated in fuel tank 20 may be routed to fuel vapor recovery system 22, described further below, via conduit 31, before being purged to the engine intake 23.

Fuel vapor recovery system 22 of fuel system 18 may include one or more fuel vapor recovery devices, such as one or more canisters filled with an appropriate adsorbent, for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor recovery system 22 may be purged to engine intake 23 by opening canister purge valve 112.

Fuel vapor recovery system 22 may further include a vent 27 which may route gases out of the recovery system 22 to the atmosphere when storing, or trapping, fuel vapors from fuel tank 20. Vent 27 may also allow fresh air to be drawn into fuel vapor recovery system 22 when purging stored fuel vapors to engine intake 23 via purge line 28 and purge valve 112. A canister check valve 116 may be optionally included in purge line 28 to prevent (boosted) intake manifold pressure from flowing gases into the purge line in the reverse direction. While this example shows vent 27 communicating with fresh, unheated air, various modifications may also be used. A detailed system configuration of fuel system 18 including fuel vapor recovery system 22 is described herein below with regard to FIG. 2, including various additional components that may be included in the intake, and exhaust.

As such, hybrid vehicle system 6 may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system. To address this, fuel tank 20 may be designed to withstand high fuel tank pressures. In particular, a fuel tank isolation valve 110 is included in conduit 31 such that fuel tank 20 is coupled to the canister of fuel vapor recovery system 22 via the valve. Isolation valve 110 may normally be kept closed to limit the amount of fuel vapors absorbed in the canister from the fuel tank. Specifically, the normally closed isolation valve separates storage of refueling vapors from the storage of diurnal vapors, and is opened during refueling to allow refueling vapors to be directed to the canister. As another example, the normally closed isolation valve may be opened during selected purging conditions, such as when the fuel tank pressure is higher than a threshold (e.g., a mechanical pressure limit of the fuel tank above which the fuel tank and other fuel system components may incur mechanical damage), to release refueling vapors into the canister and maintain the fuel tank pressure below pressure limits. The isolation valve 110 may also be closed during leak detection routines to isolate the fuel tank from the engine intake. In one example, as elaborated in FIG. 3, when sufficient vacuum is available in the fuel tank 20, an isolation valve may be closed to isolate the fuel tank and a bleed-up rate of the fuel tank vacuum (that is, a rate of decrease in fuel tank vacuum, or rate of increase in fuel tank pressure) may be monitored to identify a leak in the fuel tank.

In some embodiments, isolation valve 110 may be a solenoid valve wherein operation of the valve may be regulated by adjusting a driving signal to (or pulse width of) the dedicated solenoid (not shown). In still other embodiments, fuel tank 20 may also be constructed of material that is able to structurally withstand high fuel tank pressures, such as fuel tank pressures that are higher than a threshold and below atmospheric pressure.

One or more pressure sensors (FIG. 2) may be coupled to the fuel tank, upstream and/or downstream of isolation valve 110, to estimate a fuel tank pressure, or fuel tank vacuum level. One or more oxygen sensors (FIG. 2) may be coupled to the canister (e.g., downstream of the canister), or positioned in the engine intake and/or engine exhaust, to provide an estimate of a canister load (that is, an amount of fuel vapors stored in the canister). Based on the canister load, and further based on engine operating conditions, such as engine speed-load conditions, a purge flow rate may be determined.

Vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, and pressure sensor 129. Other sensors such as additional pressure, temperature, air/fuel ratio, and composition sensors may be coupled to various locations in the vehicle system 6, as discussed in more detail in FIG. 2. As another example, the actuators may include fuel injector 66, isolation valve 110, purge valve 112, and throttle 62. The control system 14 may include a controller 12. The controller may receive input data from the various sensors, process the input data, and trigger the actuators in response to the processed input data based on instruction or code programmed therein corresponding to one or more routines. An example control routine is described herein with regard to FIG. 3.

FIG. 2 shows an example embodiment 200 of fuel system 18 including fuel vapor recovery system 22. Fuel vapor recovery system 22 may include one or more fuel vapor retaining devices, such as fuel vapor canister 202, comprising an adsorbent. Canister 202 may receive fuel vapors from fuel tank 20 through conduit 31. During regular engine operation, isolation valve 110 may be kept closed to limit the amount of diurnal vapors directed to canister 202 from fuel tank 20. During refueling operations, and selected purging conditions, isolation valve 110 may be temporarily opened, e.g., for a duration, to direct fuel vapors from the fuel tank to canister 202. While the depicted example shows isolation valve 110 positioned along conduit 31, in alternate embodiments, the isolation valve may be mounted on fuel tank 20.

One or more pressure sensors may be coupled to fuel tank 20 for estimating a fuel tank pressure or vacuum level. While the depicted example shows pressure sensor 120 coupled to fuel tank 20, in alternate embodiments, the pressure sensor may be coupled between the fuel tank and isolation valve 110. In still other embodiments, a first pressure sensor may be positioned upstream of the isolation valve, while a second pressure sensor is positioned downstream of the isolation valve, to provide an estimate of a pressure difference across the valve.

A fuel level sensor 206 located in fuel tank 20 may provide an indication of the fuel level ("Fuel Level Input") to controller 12. As depicted, fuel level sensor 206 may comprise a float connected to a variable resistor. Alternatively, other types of fuel level sensors may be used. Fuel tank 20 may further include a fuel pump 207 for pumping fuel to injector 66.

Fuel tank 20 receives fuel via a refueling line 216, which acts as a passageway between the fuel tank 20 and a refueling door 229 on an outer body of the vehicle. During a fuel tank refueling event, fuel may be pumped into the vehicle from an external source through the refueling door. During a refueling event, isolation valve 110 may be opened to allow refueling vapors to be directed to, and stored in, canister 202.

Canister 202 may communicate with the atmosphere through vent 27. Vent 27 may include an optional canister vent valve (not shown) to adjust a flow of air and vapors between canister 202 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere Likewise, during purging operations (for example, during canister regeneration and while the engine is running), the vent valve may be opened to allow a flow of fresh air to strip the fuel vapors stored in the canister.

Fuel vapors released from canister 202, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake.

An optional canister check valve may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) may be obtained from MAP sensor 218 coupled to intake manifold 44, and communicated with controller 12. Alternatively, MAP may be inferred from alternate engine operating conditions, such as mass air flow (MAF), as measured by a MAF sensor (not shown) coupled to the intake manifold. The check valve may be positioned between the canister purge valve and the intake manifold, or may be positioned before the purge valve.

Fuel vapor recovery system 22 may be operated by controller 12 in a plurality of modes by selective adjustment of the various valves and solenoids. For example, the fuel vapor recovery system may be operated in a fuel vapor storage mode (e.g., during a fuel tank refueling operation and with the engine not running), wherein the controller 12 may open isolation valve 110 while closing canister purge valve (CPV) 112 to direct refueling vapors into canister 202 while preventing fuel vapors from being directed into the intake manifold.

As another example, the fuel vapor recovery system may be operated in a refueling mode (e.g., when fuel tank refueling is requested by a vehicle operator), wherein the controller 12 may open isolation valve 110, while maintaining canister purge valve 112 closed, to depressurize the fuel tank before allowing enabling fuel to be added therein. As such, isolation valve 110 may be kept open during the refueling operation to allow refueling vapors to be stored in the canister. After refueling is completed, the isolation valve may be closed.

As yet another example, the fuel vapor recovery system may be operated in a canister purging mode (e.g., after an emission control device light-off temperature has been attained and with the engine running), wherein the controller 12 may open canister purge valve 112 while closing isolation valve 110. Herein, the vacuum generated by the intake manifold of the operating engine may be used to draw fresh air through vent 27 and through fuel vapor canister 202 to purge the stored fuel vapors into intake manifold 44. In this mode, the purged fuel vapors from the canister are combusted in the engine. The purging may be continued until the stored fuel vapor amount in the canister is below a threshold. In an alternate embodiment, rather than using fresh air that is at atmospheric pressure, compressed air that has been passed through a boosting device (such as a turbocharger or a supercharger) may be used for a boosted purging operation. As such, fuel vapor recovery system 22 may require additional conduits and valves for enabling a boosted purging operation. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister.

Figure 3:
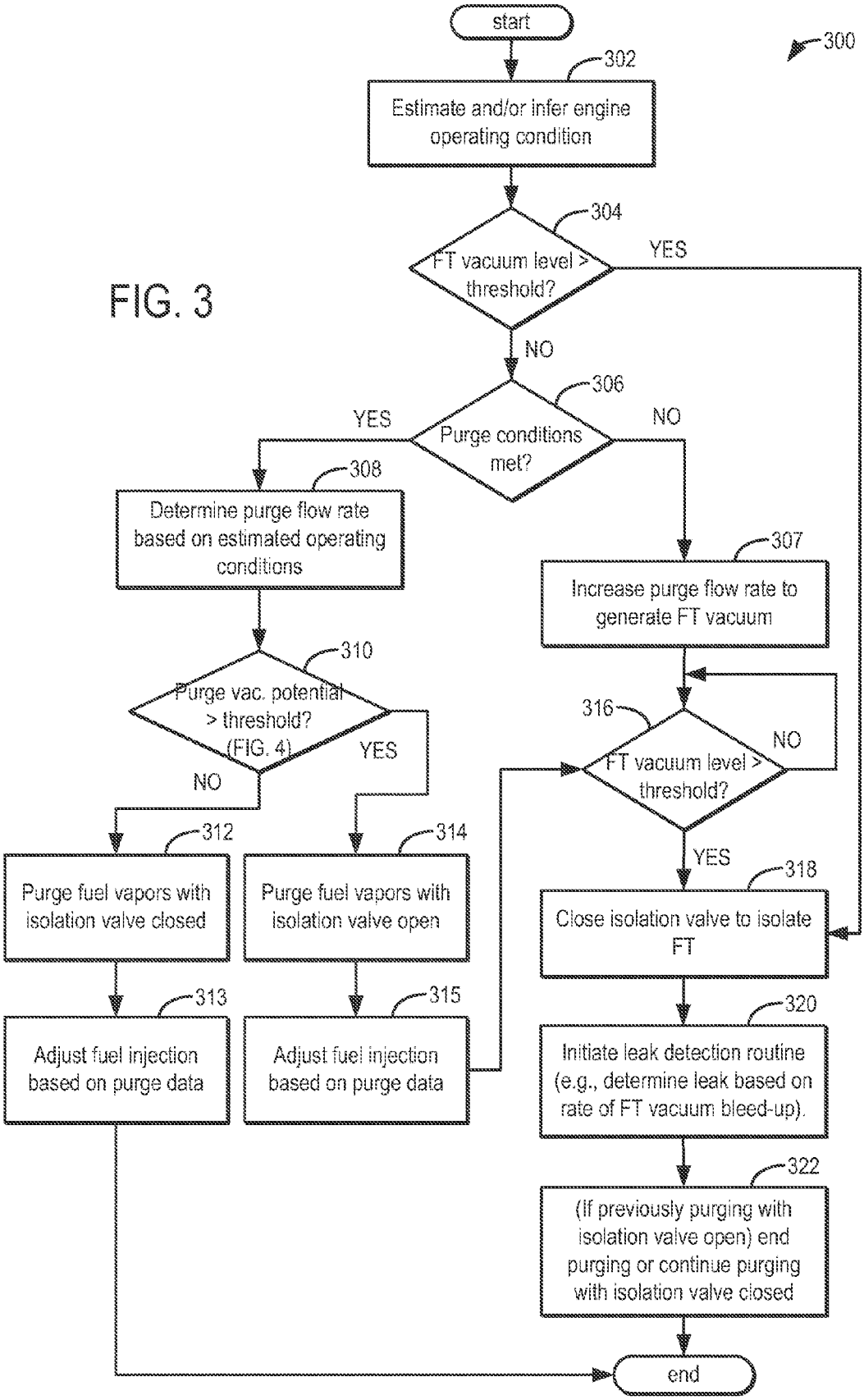
FIG. 3 shows a high level flow chart illustrating a routine for enabling vacuum generation during canister purging for a subsequent leak detection routine.
Figure 4:
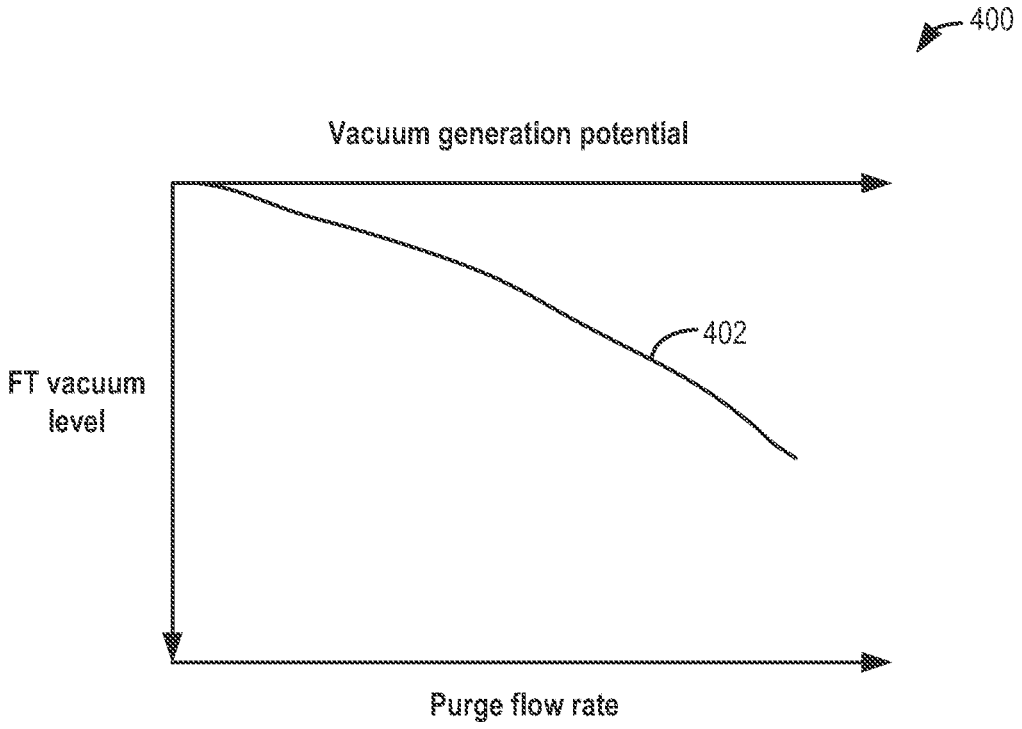
FIG. 4 shows a map for determining a vacuum generation potential of a purging operation.

The inventors herein have recognized that a vacuum potential is generated in the fuel system at the fuel tank and at the exit port of the canister that is directly proportional to the purge flow. In particular, as elaborated with reference to the map of FIG. 4, at any given fuel tank pressure as the purge flow rate of a given purging operation increases, the vacuum generation potential of the purging operation also increases. As such, the purge flow rate for a given purging operation may be determined by the prevalent engine operating conditions (e.g., engine speed and load) and based on the canister load. However, by opportunistically trapping a vacuum in the fuel tank whenever there is a potential to do so (by purging with the isolation valve open), and then closing the isolation valve when that potential has been eliminated, the vacuum potential may be advantageously used, for example, in leak detection routines (FIG. 3). Thus, during some purging conditions, when the purge flow rate is sufficiently high, fuel vapors can be purged from the canister to the engine intake with the isolation valve open to opportunistically generate fuel tank vacuum. Once sufficient fuel tank vacuum is available, the isolation valve may be closed and the generated vacuum may be applied to the fuel system to identify a leak. The purging may then be continued with the isolation valve closed such that leak detection and purging are simultaneously performed to improve the completion frequency of each operation. During other purging conditions, when the purge flow rate (as determined by the prevalent engine operating conditions) is not high enough to enable a vacuum potential, fuel vapors may be purged from the canister to the engine intake with the isolation valve closed.

Now turning to FIG. 3, an example routine 300 is described for coordinating various fuel vapor recovery system operations based on vehicle operating conditions.

At 302, engine operating conditions may be estimated and/or inferred. These may include, for example, an engine speed, an engine load, torque demand, engine coolant temperature, exhaust catalyst temperature, canister load, fuel tank pressure, time since last canister purging/storing operation etc. At 304, it may be determined if a fuel tank vacuum level is higher than a threshold level. The fuel tank vacuum level may be estimated by a pressure sensor coupled to the fuel tank. Herein, the threshold level may be a fuel tank vacuum level required to enable a fuel system leak detection routine, such as a vacuum decay (or pressure decay) based diagnostic routine.

If the vacuum level is higher than the threshold level, then the routine may directly proceed to 318 wherein an isolation valve, via which the fuel tank is coupled to the fuel vapor canister, may be closed. In this way, the fuel tank may be isolated from the engine intake. Then, at 320, a leak detection routine may be initiated. In one example, the leak detection routine may be a pressure decay based routine wherein identifying a fuel system leak includes, when a rate of vacuum decay from the isolated fuel tank is higher than a threshold rate, indicating a fuel system leak. Specifically, in response to a fast bleed-up of the fuel tank vacuum, a leak in the fuel tank may be determined and indicated by setting an appropriate diagnostic code.

If the fuel tank vacuum level is below the threshold level, then at 306, the routine confirms if purging conditions are met. Purging conditions may be considered met if, for example, the engine is running, an emission control device temperature has attained a light-off temperature, a canister fuel vapor load is higher than a threshold load, and/or a specified duration since a previous canister loading operation has elapsed. If purging conditions are met, then based on the vacuum generation potential of the purging operation, a controller may enable fuel vapors to be purged from a canister to an engine intake with an isolation valve open to generate fuel tank vacuum.

Specifically, at 308, the routine includes determining a purge flow rate based on engine operating conditions, such as engine speed and engine load, and further based on canister load. As such, a lower purge flow rate may be used as the canister loading increases due to hardware limits of the engine (e.g., injector sizing) Likewise, at higher engine speed-load conditions, a higher purge rate may be applied while at lower engine speed-load conditions, a lower purge rate may be applied to reduce air-to-fuel ratio disturbances. The purge flow rate applied at the lower engine speed-load conditions may also be constrained by the throttle body size.

At 310, it may be determined if the vacuum generation potential of the purging operation is higher than a threshold. As shown in map 400 of FIG. 4, the vacuum generation potential (graph 402) of a given purging operation may be based on the determined purge flow rate of the operation (depicted along the x-axis), as well as a current vacuum level (depicted along the y-axis) of a vacuum reservoir coupled to the canister being purged (herein, the fuel tank). Specifically, as the purge flow rate increases, while the fuel tank vacuum level of the fuel tank decreases, a vacuum generation potential of the purging may increase (in proportion to the purge flow rate). Likewise, for a given purge flow rate (as determined based on engine operation conditions and the amount of fuel vapors stored in the canister), the vacuum generation potential of the purging may increase as the fuel tank vacuum level decreases. A controller may be configured to use a map, such as map 400 of FIG. 4, to assess if the determined purge flow rate of the current purging operation (at the current fuel tank vacuum level) has sufficient vacuum generation potential. In one example, if the purge flow rate (determined at 308) is higher than a threshold rate, it may be determined that the purging operation has vacuum generation potential.

If the vacuum generation potential of the purging operation is not sufficient for generating fuel tank vacuum, then at 312, the routine includes purging fuel vapors from the canister to the engine intake with the isolation valve closed. In comparison, if there is sufficient vacuum generation potential, for example, if the determined purge flow rate during the purging is higher than the threshold rate, then at 314, the routine includes purging fuel vapors from the canister to the engine intake with the isolation valve open for a duration until a threshold level of the fuel tank vacuum is generated. Herein, the duration may be based on the purge flow rate and the fuel tank vacuum level.

As such, since the purge rate is based on engine operating conditions, which vary over time, there may be conditions where when the purging is initiated, the purge rate is lower than the threshold rate and the vacuum potential of the purging is lower than the threshold potential. Thus, the purging may be initiated with the isolation valve closed. However, after some period of purging, the engine operating conditions may change causing the purge rate to also be changed. For example, a change in engine speed-load condition may enable an increase in the purge rate. The adjusted (e.g., increased) purge rate may now be higher than the threshold rate and the vacuum potential of the purging may now be higher than the threshold potential. If at this time, fuel tank vacuum is required, the purging may be continued with the isolation valve open at least until the desired fuel tank vacuum level is reached.

During some conditions, an initial purge flow rate may be further adjusted based on whether the purging is with the isolation valve open (to generate fuel tank vacuum) or with the isolation valve closed. In one example, the controller may determine an initial purge flow rate of the purging with the isolation valve open based on engine speed and load conditions. The controller may then increase the purge flow rate of the purging with the isolation valve open in response to the estimated fuel tank vacuum level being lower than the threshold level. For example, the purge flow rate may be increased as the difference between the estimated fuel tank vacuum level and the threshold vacuum level increases. As another example, the controller may increase the purge flow rate independent of the canister fuel vapor load (e.g., even though the canister load is not very high) until the threshold level of fuel tank vacuum is generated. As such, this may be possible only during high engine speed-load conditions wherein the change in purge flow rate will not substantially affect an engine air-to-fuel ratio.

As such, it will be appreciated that during the purging with the isolation valve open, a fuel tank pressure may be lower than a mechanical pressure limit of the fuel tank. In other words, the isolation valve is not opened to expunge fuel vapors from the fuel tank to the canister to maintain the fuel tank within pressure limits. Rather, the fuel tank pressure may already be within the mechanical pressure limits and a fuel tank vacuum may be opportunistically generated for a subsequent leak detection routine. At 315 and 313, a fuel injection amount to the engine cylinders may be adjusted based on the determined purge flow rate (for purging with or without the isolation valve open at 314 and 312, respectively).

If the canister is purged with the isolation valve closed, the routine may end when the purging has ended (e.g., when the canister load has been returned below a threshold fuel vapor load). If the canister is purged with the isolation valve open, the routine may continue (at least) until a threshold level of fuel tank vacuum is generated. Specifically, at 316, after the duration of purging from the canister to the engine intake with the isolation valve open, it may be determined if the fuel tank vacuum level has reached the targeted threshold level of vacuum. If not, the controller may continue purging fuel vapors to the engine intake with the isolation valve open until the threshold vacuum level is reached. In one example, the controller may start a timer and verify the fuel tank vacuum level upon elapse of the specified duration. If the target fuel tank vacuum level is not achieved at the end of the duration, the timer may be reset.

After the duration, if the threshold vacuum level is confirmed, at 318-320, the routine includes purging fuel vapors from the canister to the engine intake with the isolation valve closed while applying the generated fuel tank vacuum to identify a fuel system leak. As elaborated above, at 318, the isolation valve may be closed to isolate the fuel tank. At 320, a rate of bleed-up of the fuel tank vacuum in the isolated fuel tank may be measured to identify a leak. For example, the controller may indicate a fuel tank leak when a rate of decrease in the fuel tank vacuum is higher than a threshold rate.

At 322, if the purging was previously performed with the isolation valve open, the routine may optionally continue purging with the isolation valve closed. Herein, the method enables purging fuel vapors from the canister to the engine intake with the isolation valve closed while simultaneously detecting a leak in the fuel system. In one example, the purging may be continued after the fuel tank isolation valve is closed if the canister load is still higher than a threshold load after the duration. Herein, by performing both operations simultaneously, both operations may be completed in the same drive cycle, even if limited time is available. In an alternate embodiment, the purging may be ended based on the fuel tank vacuum level. For example, if the canister purging was for opportunistic vacuum generation and the canister fuel vapor load is lower than a threshold load, the purging may be ended when the threshold level of fuel tank vacuum is generated and the isolation valve is closed. Herein, the generated vacuum may be applied to perform a leak detection routine subsequent to (but not simultaneously with) the purging operation.

It will be appreciated that during selected conditions, even if purging conditions are otherwise not met, a purging operation may be performed to generate the desired fuel tank vacuum. For example, during selected engine speed-load conditions (such as a part throttle condition) when the canister load is not be sufficiently high to require a purging operation, fuel vapors may be purged from the canister to the engine intake with the isolation valve open at an elevated purge flow rate only to generate fuel tank vacuum. For example, at 307, in response to purging conditions not being met while there is insufficient fuel tank vacuum, a purge flow rate may be increased to generate fuel tank vacuum. Then when sufficient fuel tank vacuum has been generated (as queried at 316), the isolation valve may be closed and the leak detection routine may be initiated (at 318-320). In this way, as long as the engine's combustion stability is not impacted, a purge flow can be adjusted to increase the amount of vacuum generated, if deemed necessary.

In this way, during a first purging condition, a purge flow rate is increased in response to the canister load being higher than a threshold load (that is, to reduce canister loading) while during a second condition, the purge flow rate is increased in response to the fuel tank vacuum level being lower than a threshold level while the canister load is lower than the threshold load (that is, even though the canister is not fully loaded, the canister is purged to generate vacuum).

Figure 5:
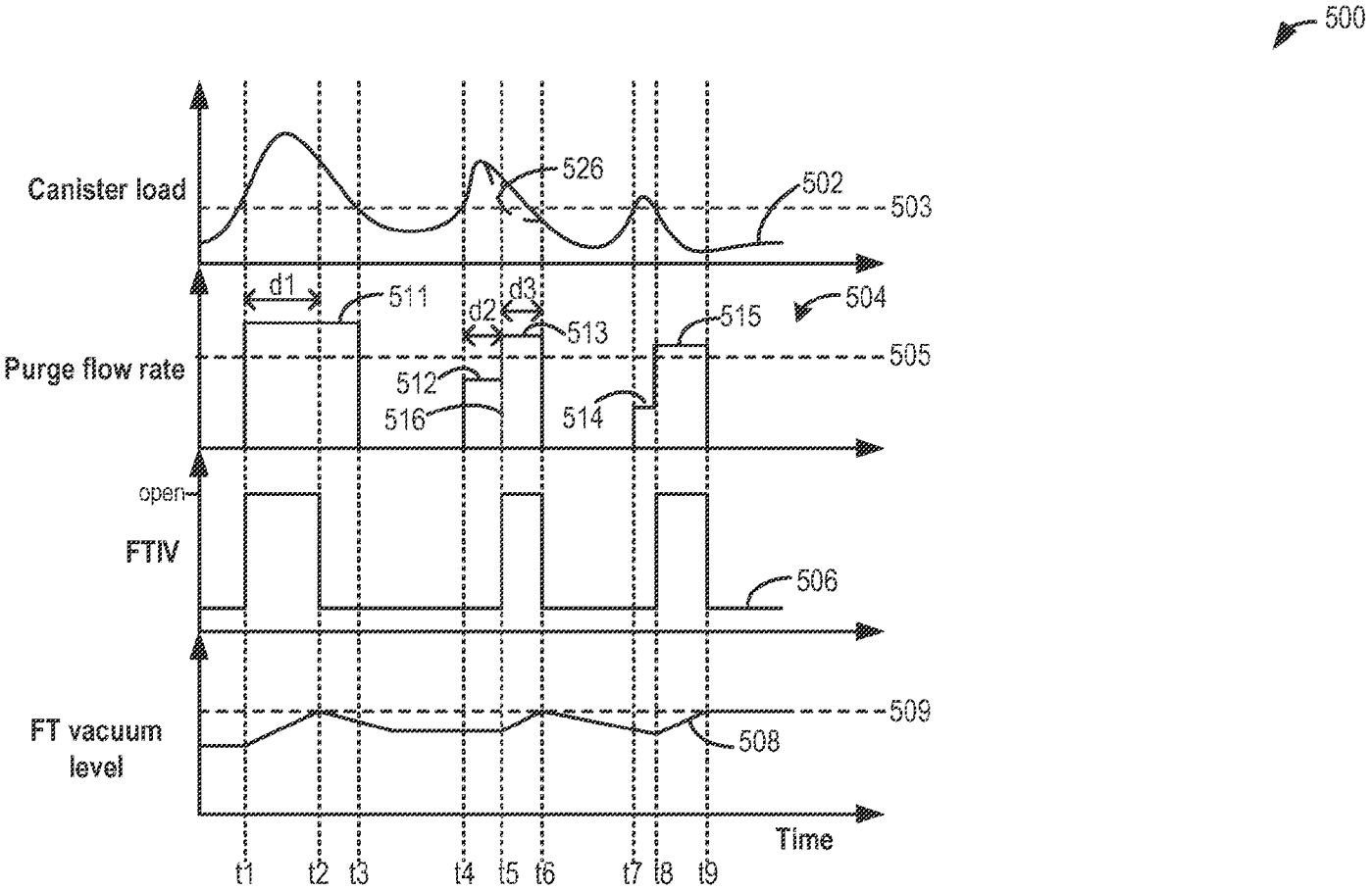
FIG. 5 shows an example of fuel vapor purging for vacuum generation and fuel system leak detection.

The method of FIG. 3 is further clarified by the example purging with vacuum generation operation of FIG. 5. Specifically, FIG. 5 includes an example map 500 depicting example purging operations that are performed with the isolation valve open or closed, as based on the vacuum generation potential of the purging operation. Map 500 depicts changes in a canister fuel vapor load at graph 502, example purge flow rates and their vacuum generation potential at graph 504, the open or closed status of a fuel tank isolation valve at graph 506, and a fuel tank vacuum level (relative to a threshold level) at graph 508. In the depicted example, at t1, a canister fuel vapor load (that is, the amount of fuel vapors stored in the canister, depicted at graph 502) may exceed a threshold load 503 and canister purging conditions may be confirmed. During this first purging condition, a fuel tank vacuum level (graph 508) may be lower than a threshold level 509. As such, threshold level 509 may correspond to an amount of fuel tank vacuum required to perform a vacuum decay based leak diagnostics routine. A purge flow rate for the purging may be determined based on the canister load, and further based on engine operating conditions, such as engine speed and load and engine airflow. In particular a first purge flow rate 511 that is higher than a threshold rate 505 may be determined. The threshold purge flow rate may reflect a purge flow rate above which a purging operation may have vacuum generation potential and below which the purging operation may not have sufficient vacuum generation potential.

In response to the higher (than the threshold) purge flow rate 511, it may be determined that the purging operation confirmed at t1 has vacuum generation potential and can generate fuel tank vacuum. Thus, to raise the fuel tank vacuum level, purging of fuel vapors from the canister to an engine intake may be performed with the isolation valve (FTIV, at graph 506) open for a (first) duration d1 (between t1 and t2) until the fuel tank vacuum level is higher than threshold level 509. The first duration may be based on the canister load, engine load, and fuel tank vacuum level. Thus, the first duration dl may increase as a difference between the (estimated) fuel tank vacuum level and the threshold vacuum level 503 for enabling a leak detection routine increases. At t2, the isolation valve may be closed. However, since the canister load remains above threshold load 503 (that is, the canister is not sufficiently purged), after the duration dl, purging of fuel vapors from the canister to the engine intake may be continued (until t3) with the isolation valve closed. In one example, after the duration d1, at t2, a leak detection routine may be initiated wherein a fuel tank leak may be determined if a rate of decrease in the fuel tank vacuum level (that is, slope of graph 508 after t2) is higher than a threshold rate. Herein, between t2 and t3, purging of canister fuel vapors to the engine intake with the isolation valve closed may be performed simultaneously with the detecting of a leak in the fuel system. As such, this allows both operations to be completed within the same drive cycle.

At t4, the canister fuel vapor load may again exceed threshold load 503 and canister purging conditions may be confirmed. During this second purging condition, the fuel tank vacuum level may also be lower than threshold level 509. However, the second purge flow rate 512 determined for the second purging operation may be lower than threshold rate 505 and it may be determined that the purging operation confirmed at t4 does not have sufficient vacuum generation potential. Consequently, purging of fuel vapors from the canister to the engine intake may be performed with the isolation valve closed for a (second) duration d2 (between t4 and t5).

In one example, the purging may be ended at t5 after the second duration has elapsed (see dashed line 516). For example, if the canister load falls below the threshold load after the second duration d2 (see dashed line 526), at t5, the purging may end. Herein, the second duration may be based on canister load and engine load (and not on fuel tank vacuum level) such that the purging ends when the canister load is restored below the threshold load 503. In the depicted example, the second duration d2 is shorter than the first duration d1.

In an alternate example, at t5, due to a change in engine operating conditions while the purging is occurring, the purge rate may change. For example, due to a sudden change in engine speed-load conditions, and/or an engine air flow, a higher purge flow rate may be applied. Specifically, the purge flow rate may be increased from the lower purge flow rate 512 to a higher purge flow rate 513 responsive to the change in engine operating conditions. The higher purge flow rate 513 may now be higher than the threshold rate 505, and the vacuum generation potential of the purging may now be higher than the threshold potential. Thus, fuel tank vacuum generation may now be possible. In response to the increase in purge flow rate while the fuel tank vacuum is still lower than the threshold level, at t5, the isolation valve may be opened and the purging may be continued with the isolation valve open at least until the threshold fuel tank vacuum level is reached at t6. Thus in the depicted example, for the given purging operation (occurring between t4 and t6), at least a portion of the purging (between t4 and t5) may be performed with the isolation valve closed (due to the lower purge flow rate and the lower vacuum generation potential of that portion of the purging), while another portion of the purging (between t5 and t6) may be performed with the isolation valve open (due to the higher purge flow rate and the higher vacuum generation potential of that portion of the purging). That is, the vacuum generation potential of the purging operation may be opportunistically taken advantage of for generating fuel tank vacuum.

At t7, the canister fuel vapor load may again exceed threshold load 503 and canister purging conditions may be confirmed. During this purging condition, the fuel tank vacuum level may also be lower than threshold level 509. In addition, a purge flow rate 514 determined for the purging operation may be lower than threshold rate 505 and it may be determined that the purging operation confirmed at t7 does not have vacuum generation potential. Consequently, purging of fuel vapors from the canister to the engine intake may be performed with the isolation valve closed for a duration between t7 and t8. At t8, the canister load may have dropped below the threshold load and no further purging may be necessitated. However, the purge rate may be increased to generate the desired fuel tank vacuum. In particular, at t8, the purge flow rate may be increased from purge flow rate 514 (that is dependent on the canister load) to a purge flow rate 515 (that is independent of the canister load) and purging of fuel vapors from the canister to the engine intake may be performed for a duration between t8 and t9 with the isolation valve open solely for the purpose of generating fuel tank vacuum until the threshold level of vacuum 509 is attained (at t9). In one example, the purge flow rate used solely for generating the tank vacuum may be a maximum purge flow rate. At t9, the isolation valve may be closed and purging may be discontinued. In this example, an ending of the purging may be adjusted based on the fuel tank vacuum level, wherein the purging is ended when the fuel tank vacuum level reaches the threshold level.

It will be appreciated that during each of the example purging conditions depicted in FIG. 5, wherein purging is performed with the isolation valve open, a fuel tank pressure may be lower than a mechanical pressure limit of the fuel tank. That is, the isolation valve may be opened to draw a fuel tank vacuum but not to expel fuel vapors from the fuel tank to the canister (as may be done during selected conditions to depressurize a fuel tank for reducing the likelihood of mechanical damage to fuel system components).

As such, the depicted examples illustrate various purging conditions during which the fuel tank vacuum level is lower than a threshold level. It will be appreciated that during other purging conditions, the fuel tank vacuum level may be higher than the threshold level wherein purging of fuel vapors from the canister to the engine intake may be performed with the isolation valve closed.

In this way, the vacuum generation potential of a purging operation may be opportunistically used to draw sufficient fuel tank vacuum for enabling fuel system leak diagnostics. By drawing a fuel tank vacuum and performing the leak detection routine under consistent and uniform conditions, cycle-to-cycle variability in test results may be reduced. By enabling purging and leak detection to be simultaneously performed, completion of both operations may be better ensured. Consequently, emissions compliance may be improved.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, 1-4, 1-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method of operating a fuel system including a fuel tank coupled to a fuel vapor canister via an isolation valve, comprising, purging fuel vapors from the canister to an engine intake at a higher purge rate for a duration with the isolation valve open until a threshold level of fuel tank vacuum is generated; and after the duration, purging fuel vapors from the canister to the engine intake at a lower purge rate with the isolation valve closed.

2. The method of claim 1, wherein the duration is based on a purge flow rate and a fuel tank vacuum level.

3. The method of claim 2, wherein the threshold level includes a fuel tank vacuum level required to enable a fuel system leak detection routine.

4. The method of claim 1, wherein during the purging, a vacuum generation potential of the purging is higher than a threshold, the vacuum generation potential based at least on a purge flow rate.

5. The method of claim 1, wherein the purging includes increasing a purge flow rate independent of a canister fuel vapor load until the threshold level of fuel tank vacuum is generated.

6. The method of claim 1, wherein after the duration, purging fuel vapors from the canister to the engine intake with the isolation valve closed occurs simultaneously with applying the generated fuel tank vacuum to the fuel system to identify a fuel system leak.

7. The method of claim 5, wherein identifying the fuel system leak includes, when a rate of vacuum decay from the isolated fuel tank is higher than a threshold rate, indicating a fuel system leak.

8. The method of claim 1, wherein during the purging with the isolation valve open, a fuel tank pressure is lower than a mechanical pressure limit of the fuel tank.

9. The method of claim 1, further comprising, after the threshold level of fuel tank vacuum is generated, ending the purging and applying the generated fuel tank vacuum to the fuel system to identify a fuel system leak.

10. A method of operating a fuel system including a fuel tank coupled to a canister via an isolation valve, comprising:

during a first purging condition, purging fuel vapors from the canister to an engine intake at a first, higher purge flow rate, with the isolation valve open; and during a second purging condition, purging fuel vapors from the canister to the engine intake at a second, lower purge flow rate, with the isolation valve closed, wherein during each of the first and second purging conditions, a fuel tank pressure is within a mechanical pressure limit of the fuel tank.

11. The method of claim 10, wherein during the first condition, a fuel tank vacuum level is lower than a threshold level, and wherein during the second condition, the fuel tank vacuum level is higher than the threshold level.

12. The method of claim 11, wherein the second purge flow rate is based on a canister fuel vapor load, and wherein the first purge flow rate is independent of the canister fuel vapor load.

13. The method of claim 10, wherein during the first condition, the purging is for a first duration based on canister load, engine load, and fuel tank vacuum level, and wherein during the second condition, the purging is for a second duration based on canister load and engine load, the first duration being longer than the second duration.

14. The method of claim 12, wherein the first duration increases as a difference between the fuel tank vacuum level and a threshold vacuum level for enabling a leak detection routine increases.

15. The method of claim 10, further comprising, during the first condition, after the first duration has elapsed, purging fuel vapors from the canister to the engine intake with the isolation valve closed while simultaneously detecting a leak in the fuel tank.

16. The method of claim 15, wherein the detecting is based on a rate of vacuum decay from the fuel tank with the isolation valve closed.

17. A fuel system for a vehicle comprising:

a fuel tank;

a canister coupled to the fuel tank via a valve;

an engine including an intake;

a pressure sensor coupled to the fuel tank and configured to estimate a fuel tank vacuum level; and a control system with computer readable instructions for:

purging fuel vapors from the canister to the engine intake with the isolation valve open for a duration until the fuel tank vacuum level is higher than a threshold vacuum level;

after the duration, purging fuel vapors from the canister to the engine intake with the isolation valve closed while simultaneously detecting a leak in the fuel system;

determining an initial purge flow rate of the purging with the isolation valve open based on engine speed, engine load, and canister load; and increasing the purge flow rate of the purging with the isolation valve open in response to the estimated fuel tank vacuum level being lower than the threshold level.

18. The system of claim 17, wherein detecting the leak in the fuel system includes indicating a fuel tank leak when a rate of decrease in the fuel tank vacuum level is higher than a threshold rate.

* * * * *